US010575640B2

(12) United States Patent
Rondina

(10) Patent No.: US 10,575,640 B2
(45) **Date of Patent: *Mar. 3, 2020**

(54) FURNITURE LEG SOCK

(71) Applicant: Nancy K Rondina, Naples, FL (US)

(72) Inventor: Nancy K Rondina, Naples, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/368,015

(22) Filed: Mar. 28, 2019

(65) Prior Publication Data

US 2019/0254428 A1 Aug. 22, 2019

Related U.S. Application Data

(60) Division of application No. 15/874,080, filed on Jan. 18, 2018, which is a division of application No. 15/582,836, filed on May 1, 2017, now Pat. No. 9,877,583, which is a division of application No. 14/685,726, filed on Apr. 14, 2015, now Pat. No. 9,668,575, which is a continuation-in-part of application No. 12/075,283, filed on Mar. 11, 2008, now abandoned.

(60) Provisional application No. 60/963,061, filed on Aug. 3, 2007.

(51) Int. Cl.

| | |
|---|---|
| ***A47B 91/06*** | (2006.01) |
| ***A47B 91/12*** | (2006.01) |
| ***A47B 91/04*** | (2006.01) |
| ***A47C 7/00*** | (2006.01) |
| ***A47B 91/00*** | (2006.01) |

(52) U.S. Cl.

CPC ..... *A47B 91/06* (2013.01); *A47B 91/002* (2013.01); *A47B 91/04* (2013.01); *A47B 91/12* (2013.01); *A47C 7/002* (2013.01); *Y10T 16/191* (2015.01); *Y10T 16/209* (2015.01); *Y10T 16/21* (2015.01)

(58) Field of Classification Search

CPC ..... A47B 91/06; A47B 91/002; A47B 91/04; A47B 91/12; A47C 7/002; Y10T 16/191; Y10T 16/209; Y10T 16/21; E06C 7/42

USPC ..... 16/42 R, 30, 42 T; 248/188.9, 346.11, 248/345.1, 346.07, 677; 182/108

See application file for complete search history.

(56) References Cited

U.S. PATENT DOCUMENTS

| | | | |
|---|---|---|---|
| 879,471 | A | 2/1908 | Kabureck |
| 1,802,479 | A | 4/1931 | Robinson |
| 1,848,501 | A | 3/1932 | Stevens |
| 2,217,754 | A | 10/1940 | Johnson |
| D166,618 | S | 4/1952 | Mince |
| 2,689,351 | A | 9/1954 | Schindler |
| 2,771,691 | A | 11/1956 | Luchs |
| 2,904,128 | A | 9/1959 | Boham et al. |
| 2,910,995 | A | 11/1959 | Jacuzzi |

(Continued)

OTHER PUBLICATIONS

"What to do with old socks?—Trash to Treasure Forum—Garden Web," http://ths.gardenweb.com/forums/load/treasure/msg0308525613055.html?17, Mar. 12, 2006.

(Continued)

*Primary Examiner* — William L Miller

(74) *Attorney, Agent, or Firm* — Michael J. Nickerson; Basch & Nickerson LLP

(57) ABSTRACT

A furniture leg protective sock is constructed of a stretchable/expandable non-friction material, which forms an outer surface and an inner surface. The furniture leg protective sock includes non-penetrating material to prevent the furniture leg from piercing through the non-friction material.

15 Claims, 8 Drawing Sheets

(56) References Cited

U.S. PATENT DOCUMENTS

| | | | |
|---|---|---|---|
| 2,925,877 | A | 2/1960 | Wright |
| 2,994,152 | A | 8/1961 | Donahue |
| 3,062,319 | A | 3/1962 | Wright |
| 3,144,236 | A | 8/1964 | Clanin |
| 3,177,884 | A | 4/1965 | Thro |
| 3,199,819 | A | 8/1965 | Widmark |
| 3,303,865 | A | 2/1967 | Ouimet |
| 3,590,390 | A | 7/1971 | Howard |
| 3,643,905 | A | 2/1972 | Kint |
| 3,662,856 | A | 5/1972 | D'Amico et al. |
| 3,874,001 | A | 4/1975 | Patience et al. |
| 3,938,570 | A | 2/1976 | Stewart |
| 3,981,088 | A | 9/1976 | Mitchell et al. |
| 3,993,163 | A | 11/1976 | Barrett |
| 4,048,818 | A | 9/1977 | Cueman |
| 4,135,536 | A | 1/1979 | Willis |
| 4,373,215 | A | 2/1983 | Guigley |
| 4,726,446 | A | 2/1988 | Perbix |
| 4,771,862 | A | 9/1988 | Garland |
| 4,817,902 | A | 4/1989 | Mason |
| 4,829,889 | A | 5/1989 | Takeuchi et al. |
| 4,899,848 | A | 2/1990 | Parr |
| 4,998,699 | A | 3/1991 | Butler |
| 5,032,135 | A | 7/1991 | Jacobson |
| 5,088,513 | A | 2/1992 | Ostermeyer |
| 5,284,194 | A | 2/1994 | Gaffney |
| 5,301,704 | A | 4/1994 | Brown |
| D348,985 | S | 7/1994 | Walker |
| 5,331,989 | A | 7/1994 | Stephens |
| 5,533,591 | A | 7/1996 | Kiska |
| 5,564,782 | A | 10/1996 | LaGrange et al. |
| 5,593,453 | A | 1/1997 | Ahlert |
| 5,675,992 | A | 10/1997 | Wrightenberry |
| 5,752,278 | A | 5/1998 | Gunn |
| 5,778,605 | A | 7/1998 | Ellena et al. |
| 5,826,606 | A | 10/1998 | Davenport |
| 5,992,434 | A | 11/1999 | Berlin |
| 6,095,214 | A | 8/2000 | Gaffney |
| 6,102,810 | A | 8/2000 | Boland |
| 6,138,281 | A | 10/2000 | Chiaruttini |
| 6,385,779 | B2 | 5/2002 | Boersema |
| 6,499,563 | B1 | 12/2002 | Bremick |
| D491,793 | S | 6/2004 | Corso |
| 6,871,516 | B2 | 3/2005 | Peeler |
| 6,910,246 | B2 | 6/2005 | Desmarais |
| 7,108,102 | B2 | 9/2006 | Woodward |
| 7,124,986 | B1 | 10/2006 | Bailey |
| 7,159,830 | B2 | 1/2007 | Frank |
| D555,258 | S | 11/2007 | Wirch |
| 8,408,223 | B2 | 4/2013 | Brown |
| 8,438,701 | B2 | 5/2013 | Bushey |
| 8,726,463 | B2 | 5/2014 | Bushey et al. |
| 2004/0089775 | A1 | 5/2004 | Shaw |
| 2005/0082455 | A1 | 4/2005 | Jones |
| 2005/0144703 | A1 | 7/2005 | Hilbert |
| 2008/0032056 | A1 | 2/2008 | Whang et al. |
| 2008/0209686 | A1 | 9/2008 | Lang |
| 2012/0068034 | A1 | 3/2012 | Desmarais |
| 2013/0200091 | A1 | 8/2013 | Scott-Womack |
| 2015/0053148 | A1* | 2/2015 | Huang ..... A01K 13/007 119/850 |
| 2015/0216304 | A1* | 8/2015 | Rondina ..... A47B 91/12 16/30 |
| 2015/0223602 | A1* | 8/2015 | Rondina ..... A47B 91/12 16/42 R |

OTHER PUBLICATIONS

"Nankits" http://msnanknits.blogspot.com/2007_06-01_archive.html, Jun. 1, 2007.

* cited by examiner

FURNITURE LEG SOCK

PRIORITY INFORMATION

The present application is a divisional application of co-pending U.S. patent application Ser. No. 15/874,080, filed on Jan. 18, 2018, and claims priority, under 35 U.S.C. § 120, from U.S. patent application Ser. No. 15/874,080, filed on Jan. 18, 2018; said U.S. patent application Ser. No. 15/874,080, filed on Jan. 18, 2018, being a divisional application of and claiming priority, under 35 U.S.C. § 120, from U.S. patent application Ser. No. 15/582,836, filed on May 1, 2017; said U.S. patent application Ser. No. 15/582,836, filed on May 1, 2017 being a divisional application of said U.S. patent application Ser. No. 14/685,726, filed on Apr. 14, 2015, (now U.S. Pat. No. 9,668,575); said U.S. patent application Ser. No. 14/685,726, filed on Apr. 14, 2015, being a continuation-in-part of U.S. patent application Ser. No. 12/075,283, filed on Mar. 11, 2008, and claiming priority, under 35 U.S.C. § 120, from U.S. patent application Ser. No. 12/075,283, filed on Mar. 11, 2008 (now abandoned); said U.S. patent application Ser. No. 12/075,283, filed on Mar. 11, 2008 claiming priority, under 35 U.S.C. § 119(e), from U.S. Provisional Patent Application No. 60/963,061, filed on Aug. 3, 2007.

The present application claims priority, under 35 U.S.C. § 120, from U.S. patent application Ser. No. 15/874,080, filed on Jan. 18, 2018. The entire content of U.S. patent application Ser. No. 15/874,080, filed on Jan. 18, 2018, is hereby incorporated by reference.

The present application claims priority, under 35 U.S.C. § 120, from U.S. patent application Ser. No. 15/582,836, filed on May 1, 2017. The entire content of U.S. patent application Ser. No. 15/582,836, filed on May 1, 2017, is hereby incorporated by reference.

The present application claims priority, under 35 U.S.C. § 120, from U.S. patent application Ser. No. 14/685,726, filed on Apr. 14, 2015. The entire content of U.S. patent application Ser. No. 14/685,726, filed on Apr. 14, 2015, is hereby incorporated by reference.

The present application claims priority, under 35 U.S.C. § 120, from U.S. patent application Ser. No. 12/075,283, filed on Mar. 11, 2008. The entire content of U.S. patent application Ser. No. 12/075,283, filed on Mar. 11, 2008, is hereby incorporated by reference.

The present application claims priority, under 35 U.S.C. § 119(e), from U.S. Provisional Patent Application No. 60/963,061, filed on Aug. 3, 2007. The entire content of U.S. Provisional Patent Application No. 60/963,061, filed on Aug. 3, 2007, is hereby incorporated by reference.

BACKGROUND

To prevent a floor from being damaged when a chair or table is moved, various sizes of felt disks or other soft material has been, conventionally, fastened to the bottom of the chair or table legs. The conventional protective materials are usually attached to the bottom of the furniture legs by adhesives or mechanical fasteners.

Conventional protective products are not durable, and the adhesives tend to lose adhesiveness, ultimately causing the bond to fail. Mechanically connecting a conventional leg covering to the bottom of a furniture leg creates problems in that when the felt deteriorates, the remaining mechanical fastener contributes to a scraping on the floor.

U.S. Pat. No. 6,910,246 illustrates a conventional furniture leg glide in the form of a cup which is slid over the leg.

It has an accordion-type section that will adjust itself to any slanting of a furniture leg. The entire content of U.S. Pat. No. 6,910,246 is hereby incorporated by reference.

U.S. Pat. No. 7,159,830 shows a conventional leg slide protector in the form of a spirally wound tube that is inserted into a bore of the leg. This type of protection can be quite cumbersome and expensive to manufacture. The entire content of U.S. Pat. No. 7,159,830 is hereby incorporated by reference.

U.S. Pat. No. 7,124,986 discloses a conventional protective cover for use on the bottom of chairs and table legs. An elastomeric sleeve or cup has a bottom to which is connected a disk or soft dense material such as felt. The entire content of U.S. Pat. No. 7,124,986 is hereby incorporated by reference.

The protective device consists of a sock to be applied to a bottom of a furniture leg. The sock is made of an elastic material and made on a circular knitting machine. The inside surface of the sock has applied thereto a friction material to enhance the friction between the sock and the furniture leg. A top of the circular material is doubled back upon itself to form a double seam. The bottom of the sock is closed by an overcast seam and, ordinarily, does not require any additional material, such as felt, to act in its protective purpose, and that is, to protect a floor from being scratched or marred. However, there times and occasions when additional protection material may be useful such as a felt pad. Such a felt pad may be adhesively applied to a bottom of the sock or on the inside.

BRIEF DESCRIPTION OF THE DRAWINGS

The drawings are only for purposes of illustrating various embodiments and are not to be construed as limiting, wherein.

DETAILED DESCRIPTION OF THE DRAWINGS

Figure 1:
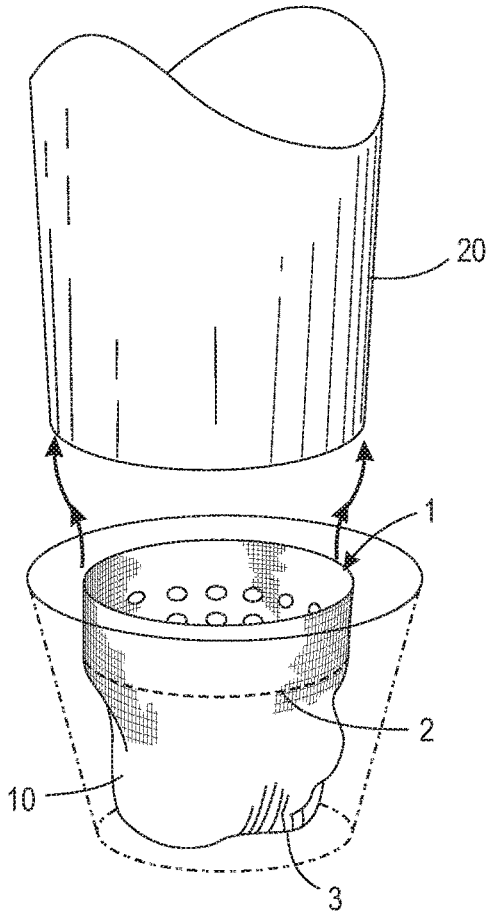
FIG. 1 illustrates a furniture leg and a flexible furniture leg sock prior to being placed on the leg.

For a general understanding, reference is made to the drawings. In the drawings, like references have been used throughout to designate identical or equivalent elements. It is also noted that the drawings may not have been drawn to scale and that certain regions may have been purposely drawn disproportionately so that the features and concepts may be properly illustrated.

FIG. 1 illustrates a flexible furniture leg sock 10 prior to being placed on a furniture leg 20. The possible expansion is shown by phantom lines in FIGS. 1 and 2.

Figure 2:
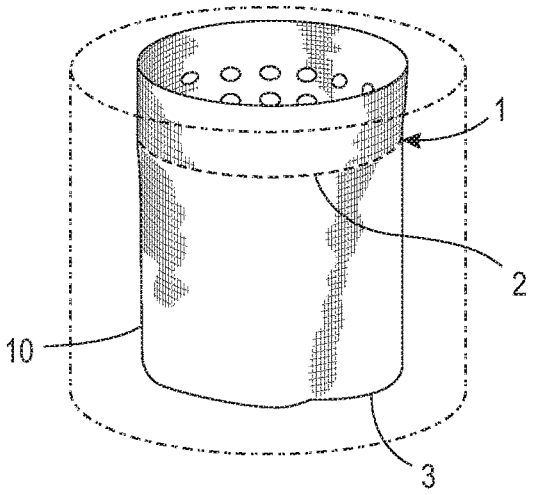
FIG. 2 illustrates just a flexible furniture leg sock having expansion properties.

FIG. 2 illustrates the flexible furniture leg sock 10 by itself, wherein the flexible furniture leg sock 10 has an upper double thickness by doubling back upon itself and being secured by a seam 2.

The flexible furniture leg sock 10 may be made of knitted material, such as yarns. The yarns in the knitting process may consist of at least two different yarns such as elastic and/or non-elastic. The elastic yarns may be a spandex-type yarn. The knitting is accomplished by a narrow gauge knitting machine which initially will knit an endless tubular hose.

Figure 4:
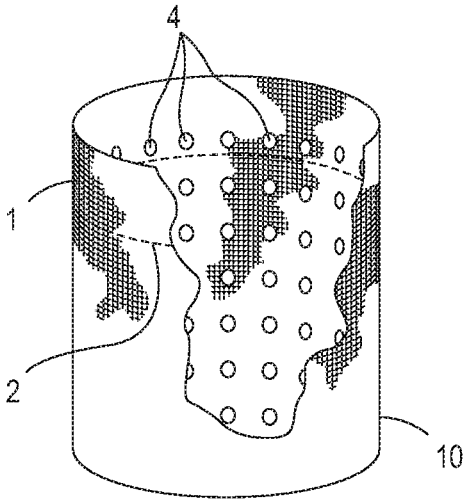
FIG. 4 illustrates an interior of the flexible furniture leg sock with friction material placed therein.

Once the hose is knitted, it will be turned inside out and a friction material 4, such as rubber knobs, as illustrated in FIG. 4, can be applied to the interior surface of the flexible furniture leg sock 10.

It is noted that the application of friction material 4 may be done in a geometric pattern.

After this procedure, the tube will be turned right side out again and an appropriate length will be cut and a double thickness will then be formed by turning a short section of the cut tube inwardly and fasten the same by an appropriate seam 2.

This procedure provides a finished top portion of the flexible furniture leg sock 10.

The open bottom end of the flexible furniture leg sock 10 may be closed on a sewing machine by making an overcast seam 3.

In contrast to the conventional devices disclosed above, the flexible furniture leg sock 10 has no material disks, such as felt, applied to the bottom of the flexible furniture leg sock 10 because the overcast seam 3 provides enough of a cushion to protect the floor below from being marred or scratched.

Figure 3:
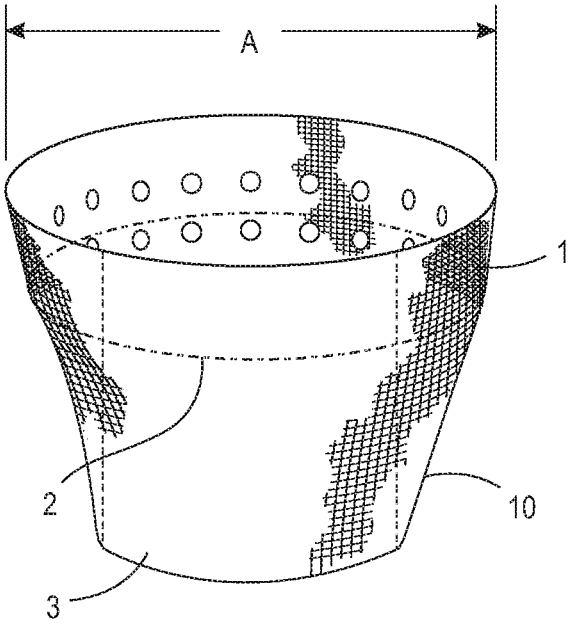
FIG. 3 illustrates the flexible furniture leg sock in an expanded state.

FIG. 3 shows the top of the flexible furniture leg sock 10 as it can be expanded by arrow A prior to being slipped over a furniture leg. The parallel phantom lines of FIG. 3 illustrate the normal width of the flexible furniture leg sock 10, while the arrow A shows the possible expansion of the flexible furniture leg sock 10.

FIG. 4 illustrates a broken open view of the inside of the flexible furniture leg sock 10. This view shows the friction material 4 after having been applied to the inside surface of the flexible furniture leg sock 10. In this view, there are rubber dots which will provide friction against the furniture leg 20 once the flexible furniture leg sock 10 is applied to the leg 20.

It is noted that other types of friction material patterns, such as horizontal lines or open circles, etc., may be utilized.

As illustrated in FIGS. 1-4, a furniture leg protective sock is provided that prevents the scraping of a floor by a furniture leg. The furniture leg protective sock includes an expandable non-friction material and a friction material.

The expandable non-friction material includes a top portion having an interior surface, an exterior surface and an opening to slip the sock onto the furniture leg; a closed bottom portion having an interior surface and an exterior surface, the closed bottom portion being position between the bottom surface of the furniture leg and the floor when the closed bottom portion engages the furniture leg; and a middle portion having an interior surface and an exterior surface, the middle portion extending between the opening of the top portion and the closed bottom portion, the middle portion engaging the side surface of the furniture leg.

The middle portion is substantially orthogonal, when the closed bottom portion and the middle portion engage the furniture leg, to the closed bottom portion.

The friction material is applied only to a portion of the interior surface of the closed bottom portion and to a portion of the interior surface of the middle portion. The friction material is applied so that the friction material and the interior surface of the closed bottom portion engage the bottom surface of the furniture leg. The friction material is also applied so that the friction material and the interior surface of the middle bottom portion engage the side surface of the furniture leg.

The friction material minimizes, when the furniture leg is moved across the floor, slippage of the sock parallel to the bottom surface of the furniture leg by providing friction therebetween and minimizes slippage of the sock parallel to the side surface of the furniture leg by providing friction therebetween.

The exterior surface of the top portion, closed bottom portion, and the middle portion are without any of the friction material.

It is noted that furniture leg protective sock is capable of being stretched to different widths.

Figure 5:
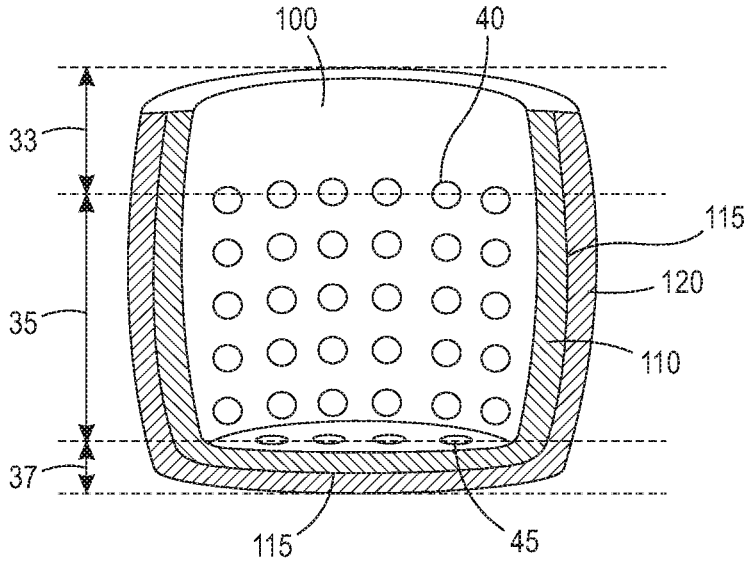
FIG. 5 illustrates a double layered flexible furniture leg sock.

With respect to FIG. 5, a furniture leg protective sock 100 is constructed on a stretchable/expandable non-friction material, which is double-layered to form an outer layer 120, an inner layer 110, and a gap 115 therebetween. As illustrated, the furniture leg protective sock 100 is "cupped" shape, wherein the outer layer 120 forms an outer surface of the "cupped" shaped furniture leg protective sock 100, and inner layer 110 forms the inner surface of the "cupped" shaped furniture leg protective sock 100.

It is noted that furniture leg protective sock 100 may have alternative shapes which include an enclosed bottom, sides, and an opened top.

The outer layer 120 has an inner surface and an outer surface, wherein the inner surface of the outer layer 120 defines a portion of the gap 115 and the outer surface of the outer layer 120 defines the outer surface of the furniture leg protective sock 100.

The inner layer 110 has an inner surface and an outer surface, wherein the inner surface of the inner layer 110 defines a portion of the gap 115 and the outer surface of the inner layer 110 defines the inner surface of the furniture leg protective sock 100.

The furniture leg protective sock 100 has an upper portion 33, a middle portion 35, and a bottom portion 37.

As illustrated in FIG. 5, the furniture leg protective sock 100 includes friction material 40 which is located on the inner surface of the furniture leg protective sock 100. More specifically, as illustrated in FIG. 5, the friction material 40 is located in the middle portion 35 and bottom portion 37 of the inner surface of the furniture leg protective sock 100.

It is noted that, in a different embodiment, the friction material 40 is located in the upper portion 33 of the inner surface of the furniture leg protective sock 100.

Figure 6:
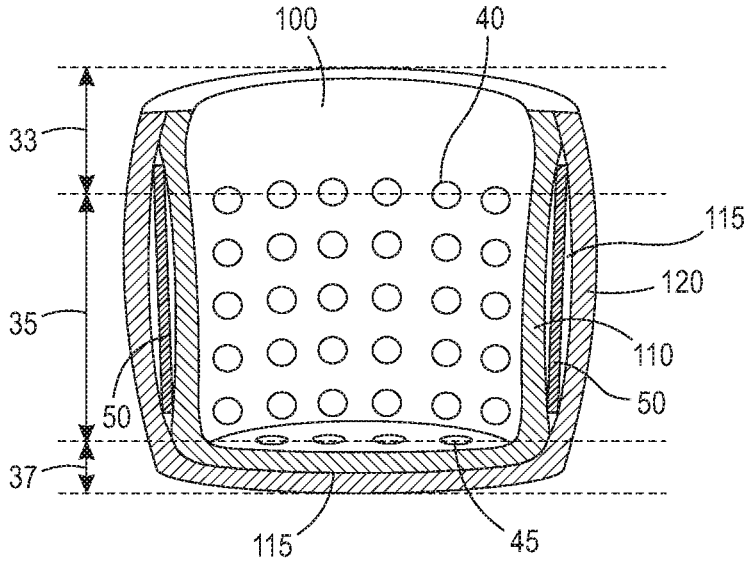
FIG. 6 illustrates a double layered flexible furniture leg sock with stabilizing material.

In FIG. 6, a furniture leg protective sock 100 is constructed on a stretchable/expandable non-friction material, which is double-layered to form an outer layer 120, an inner layer 110, and a gap 115 therebetween. As illustrated, the furniture leg protective sock 100 is "cupped" shape, wherein the outer layer 120 forms an outer surface of the "cupped" shaped furniture leg protective sock 100, and inner layer 110 forms the inner surface of the "cupped" shaped furniture leg protective sock 100.

It is noted that furniture leg protective sock 100 may have alternative shapes which include an enclosed bottom, sides, and an opened top.

The outer layer 120 has an inner surface and an outer surface, wherein the inner surface of the outer layer 120 defines a portion of the gap 115 and the outer surface of the outer layer 120 defines the outer surface of the furniture leg protective sock 100.

The inner layer 110 has an inner surface and an outer surface, wherein the inner surface of the inner layer 110 defines a portion of the gap 115 and the outer surface of the inner layer 110 defines the inner surface of the furniture leg protective sock 100.

The furniture leg protective sock 100 has an upper portion 33, a middle portion 35, and a bottom portion 37.

As illustrated in FIG. 6, the furniture leg protective sock 100 includes friction material 40 which is located on the inner surface of the furniture leg protective sock 100. More specifically, as illustrated in FIG. 5, the friction material 40 is located in the middle portion 35 and bottom portion 37 of the inner surface of the furniture leg protective sock 100.

It is noted that, in a different embodiment, the friction material 40 is located in the upper portion 33 of the inner surface of the furniture leg protective sock 100.

Moreover, as illustrated in FIG. 6, the furniture leg protective sock 100 includes stabilizing material 50, which is located in the gap (between the inner surface of the inner layer 110 and the inner surface of the outer layer 120).

FIG. 6 illustrates that the stabilizing material 50 may be located in the middle portion 35 and the upper portion 33 of the furniture leg protective sock 100. However, the stabilizing material 50 may be restricted to being only located in the middle portion 35 of the furniture leg protective sock 100.

The stabilizing material 50 provides rigidity to the furniture leg protective sock 100; however, the stabilizing material 50 is stretchable/expandable to enable the furniture leg protective sock 100 to fit over a furniture leg.

It is noted that the stabilizing material 50 may be a single device that provides rigidity and stretchability, or the stabilizing material 50 may be multiple devices that provide rigidity and stretchability.

The stabilizing material 50 may be a stabilizer like the Pelton® 70 Peltex® Ultra-firm Sew In stabilizer or any stabilizing material which provides support and expandability.

In addition, although FIG. 6 illustrates that the stabilizing material 50 is distinct material located in the gap of the furniture leg protective sock 100, the stabilizing material 50 may be a spray-on composition that provides rigidity to a cloth-based material and stretchability.

Figure 7:
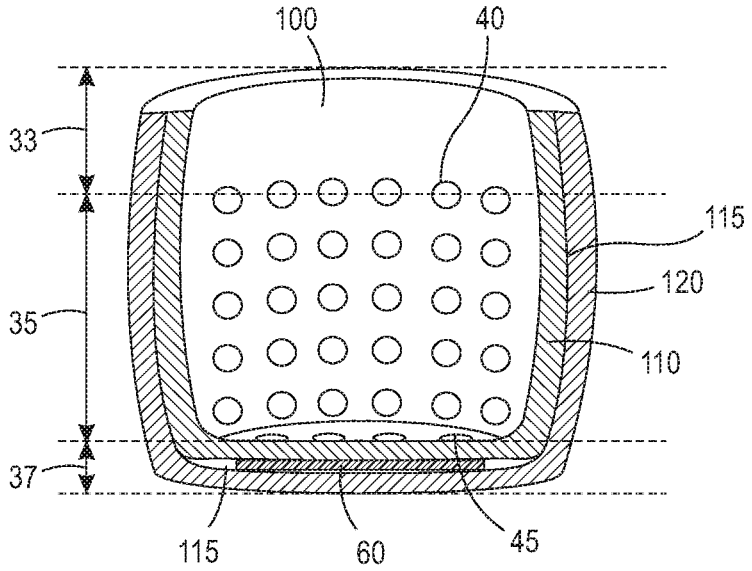
FIG. 7 illustrates a double layered flexible furniture leg sock with a non-penetration material.

In FIG. 7, a furniture leg protective sock 100 is constructed on a stretchable/expandable non-friction material, which is double-layered to form an outer layer 120, an inner layer 110, and a gap 115 therebetween. As illustrated, the furniture leg protective sock 100 is "cupped" shape, wherein the outer layer 120 forms an outer surface of the "cupped" shaped furniture leg protective sock 100, and inner layer 110 forms the inner surface of the "cupped" shaped furniture leg protective sock 100.

It is noted that furniture leg protective sock 100 may have alternative shapes which include an enclosed bottom, sides, and an opened top.

The outer layer 120 has an inner surface and an outer surface, wherein the inner surface of the outer layer 120 defines a portion of the gap 115 and the outer surface of the outer layer 120 defines the outer surface of the furniture leg protective sock 100.

The inner layer 110 has an inner surface and an outer surface, wherein the inner surface of the inner layer 110 defines a portion of the gap 115 and the outer surface of the inner layer 110 defines the inner surface of the furniture leg protective sock 100.

The furniture leg protective sock 100 has an upper portion 33, a middle portion 35, and a bottom portion 37.

As illustrated in FIG. 7, the furniture leg protective sock 100 includes friction material 40 which is located on the inner surface of the furniture leg protective sock 100. More specifically, as illustrated in FIG. 7, the friction material 40 is located in the middle portion 35 and bottom portion 37 of the inner surface of the furniture leg protective sock 100.

It is noted that, in a different embodiment, the friction material 40 is located in the upper portion 33 of the inner surface of the furniture leg protective sock 100.

Moreover, as illustrated in FIG. 7, the furniture leg protective sock 100 includes non-penetrating material 60, which is located in the gap (between the inner surface of the inner layer 110 and the inner surface of the outer layer 120).

The non-penetrating material 60 may be composed of a rubber material or other material which would prevent a furniture leg from piercing through the furniture leg protective sock 100.

FIG. 7 illustrates that the non-penetrating material 60 is located in the bottom portion 37 of the furniture leg protective sock 100.

Although FIG. 7 illustrates that the non-penetrating material 60 is located in the gap between the inner surface of the inner layer 110 and the inner surface of the outer layer 120, the non-penetrating material 60 may be located on the inner surface of the bottom portion 37 of the furniture leg protective sock 100.

It is noted that if the non-penetrating material 60 is located on the inner surface of the bottom portion 37 of the furniture leg protective sock 100, the friction material may be formed on the non-penetrating material 60.

It is further noted that if the non-penetrating material 60 is located on the inner surface of the bottom portion 37 of the furniture leg protective sock 100 and the non-penetrating material 60 is composed of a rubber material, the friction material may be left off the bottom portion 37 of the furniture leg protective sock 100.

Figure 8:
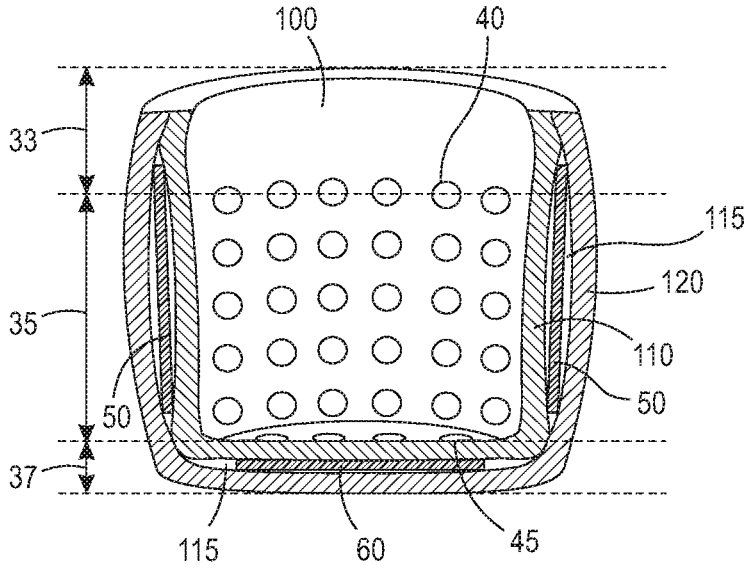
FIG. 8 illustrates a double layered flexible furniture leg sock with stabilizing material and a non-penetration material.

In FIG. 8, a furniture leg protective sock 100 is constructed on a stretchable/expandable non-friction material, which is double-layered to form an outer layer 120, an inner layer 110, and a gap 115 therebetween. As illustrated, the furniture leg protective sock 100 is "cupped" shape, wherein the outer layer 120 forms an outer surface of the "cupped" shaped furniture leg protective sock 100, and inner layer 110 forms the inner surface of the "cupped" shaped furniture leg protective sock 100.

It is noted that furniture leg protective sock 100 may have alternative shapes which include an enclosed bottom, sides, and an opened top.

The outer layer 120 has an inner surface and an outer surface, wherein the inner surface of the outer layer 120 defines a portion of the gap 115 and the outer surface of the outer layer 120 defines the outer surface of the furniture leg protective sock 100.

The inner layer 110 has an inner surface and an outer surface, wherein the inner surface of the inner layer 110 defines a portion of the gap 115 and the outer surface of the inner layer 110 defines the inner surface of the furniture leg protective sock 100.

The furniture leg protective sock 100 has an upper portion 33, a middle portion 35, and a bottom portion 37.

As illustrated in FIG. 8, the furniture leg protective sock 100 includes friction material 40 which is located on the inner surface of the furniture leg protective sock 100. More specifically, as illustrated in FIG. 8, the friction material 40 is located in the middle portion 35 and bottom portion 37 of the inner surface of the furniture leg protective sock 100.

It is noted that, in a different embodiment, the friction material 40 is located in the upper portion 33 of the inner surface of the furniture leg protective sock 100.

Moreover, as illustrated in FIG. 8, the furniture leg protective sock 100 includes stabilizing material 50, which is located in the gap (between the inner surface of the inner layer 110 and the inner surface of the outer layer 120).

FIG. 8 illustrates that the stabilizing material 50 may be located in the middle portion 35 and the upper portion 33 of the furniture leg protective sock 100. However, the stabilizing material 50 may be restricted to being only located in the middle portion 35 of the furniture leg protective sock 100.

The stabilizing material 50 provides rigidity to the furniture leg protective sock 100; however, the stabilizing material 50 is stretchable/expandable to enable the furniture leg protective sock 100 to fit over a furniture leg.

It is noted that the stabilizing material 50 may be a single device that provides rigidity and stretchability, or the stabilizing material 50 may be multiple devices that provide rigidity and stretchability.

The stabilizing material 50 provides rigidity to the furniture leg protective sock 100; however, the stabilizing material 50 is stretchable/expandable to enable the furniture leg protective sock 100 to fit over a furniture leg.

In addition, although FIG. 8 illustrates that the stabilizing material 50 is distinct material located in the gap of the furniture leg protective sock 100, the stabilizing material 50 may be a spray-on composition that provides rigidity to a cloth-based material and stretchability.

Moreover, as illustrated in FIG. 8, the furniture leg protective sock 100 includes non-penetrating material 60, which is located in the gap (between the inner surface of the inner layer 110 and the inner surface of the outer layer 120).

The non-penetrating material 60 may be composed of a rubber material or other material which would prevent a furniture leg from piercing through the furniture leg protective sock 100.

FIG. 8 illustrates that the non-penetrating material 60 is located in the bottom portion 37 of the furniture leg protective sock 100.

Although FIG. 8 illustrates that the non-penetrating material 60 is located in the gap between the inner surface of the inner layer 110 and the inner surface of the outer layer 120, the non-penetrating material 60 may be located on the inner surface of the bottom portion 37 of the furniture leg protective sock 100.

It is noted that if the non-penetrating material 60 is located on the inner surface of the bottom portion 37 of the furniture leg protective sock 100, the friction material may be formed on the non-penetrating material 60.

It is further noted that if the non-penetrating material 60 is located on the inner surface of the bottom portion 37 of the furniture leg protective sock 100 and the non-penetrating material 60 is composed of a rubber material, the friction material may be left off the bottom portion 37 of the furniture leg protective sock 100.

Figure 9:
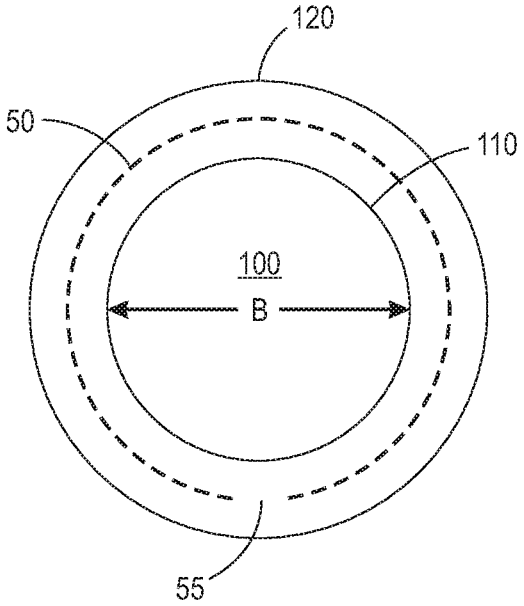
FIG. 9 illustrates a cutaway view of a double layered flexible furniture leg sock with expandable stabilizing material in a non-expanded state.

FIG. 9 illustrates a furniture leg protective sock 100 that includes an inner layer 110 and an outer layer 120 in a non-expanded state. As illustrated in FIG. 9, the inner layer 110 has a diameter of B in the non-expanded state.

Floating between the inner layer 110 and outer layer 120 is a stabilizing material 50 that provides vertical rigidity to the furniture leg protective sock 100. The stabilizing material 50 includes a stabilizing material gap 55 that allows the stabilizing material 50 to "expand" as the furniture leg protective sock 100 expands. This expansion characteristic will be discussed in more detail with respect to FIG. 10.

Figure 10:
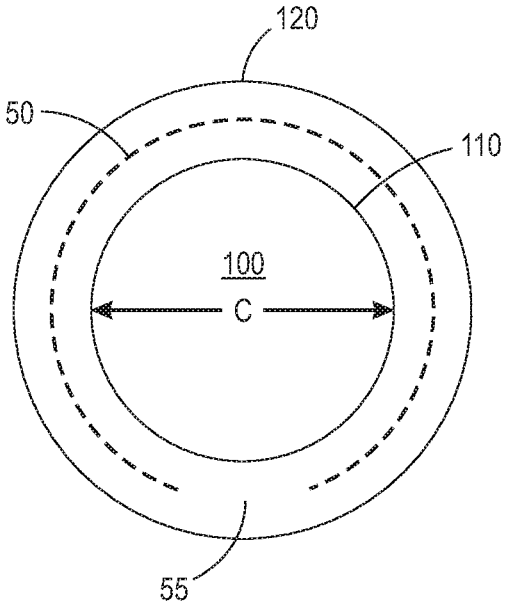
FIG. 10 illustrates a cutaway view of a double layered flexible furniture leg sock with expandable stabilizing material in an expanded state.

FIG. 10 illustrates a furniture leg protective sock 100 that includes an inner layer 110 and an outer layer 120 in an expanded state. As illustrated in FIG. 9, the inner layer 110 has a diameter of C in the expanded state. It is noted that diameter C of FIG. 10 is greater than diameter B of FIG. 9.

Floating between the inner layer 110 and outer layer 120 is a stabilizing material 50 that provides vertical rigidity to the furniture leg protective sock 100. The stabilizing material 50 includes a stabilizing material gap 55. As the diameter of the inner layer 110 increases, the width of the stabilizing material gap 55 correspondingly increases because the stabilizing material 50 floats between the inner layer 110 and outer layer 120, thereby allowing the stabilizing material 50 to "expand" with of the inner layer 110 of the furniture leg protective sock 100.

Figure 11:
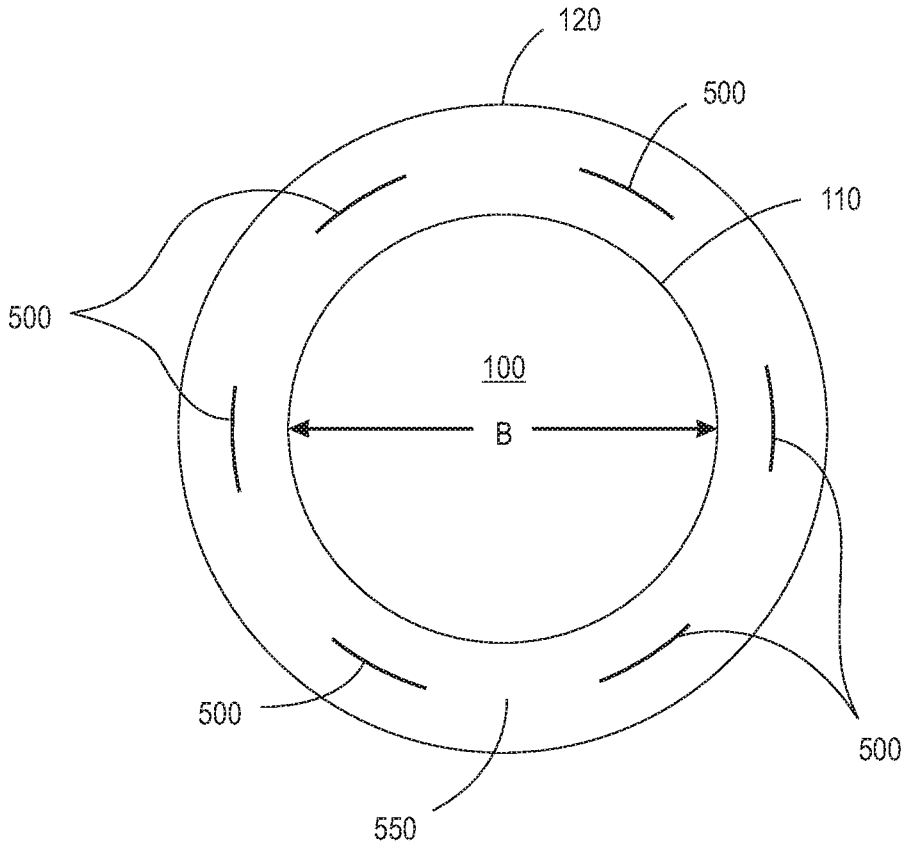
FIG. 11 illustrates a cutaway view of a double layered flexible furniture leg sock with pieces of expandable stabilizing material in a non-expanded state.

FIG. 11 illustrates a furniture leg protective sock 100 that includes an inner layer 110 and an outer layer 120 in a non-expanded state. As illustrated in FIG. 11, the inner layer 110 has a diameter of B in the non-expanded state.

Floating between the inner layer 110 and outer layer 120 are a plurality of pieces of stabilizing material 500 that provide vertical rigidity to the furniture leg protective sock 100. Between each piece of stabilizing material 500 is a stabilizing material gap 550 that allows the "stabilizing material" to "expand" as the furniture leg protective sock 100 expands.

More specifically, as the diameter of the inner layer 110 increases, the widths of the stabilizing material gaps 550 correspondingly increase, thereby allowing the stabilizing material to "expand" with of the inner layer 110 of the furniture leg protective sock 100.

It is noted that the pieces of stabilizing material 500 may be sewn or fused to the inner surface of the inner layer 110 or the inner surface of the outer layer 120 such that the pieces of stabilizing material 500 provide vertical rigidity to the furniture leg protective sock 100 and the gaps provide expandability or stretchability.

Figure 12:
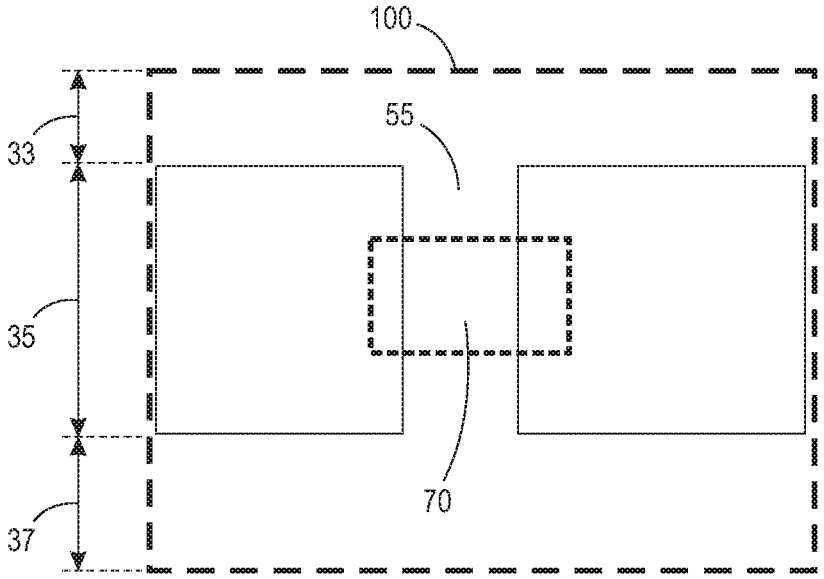
FIG. 12 illustrates a cutaway view of a double layered flexible furniture leg sock with expandable stabilizing material and an elastic member.

FIG. 12 illustrates a furniture leg protective sock 100 that includes an upper portion 33, a middle portion 35, and a bottom portion 37. As illustrated in FIG. 12, in the middle portion 35, stabilizing material 50 floats between an inner layer and an outer layer of the furniture leg protective sock 100.

To prevent the stabilizing material 50 from retaining an expanded state (larger gap), an elastic material 70 is attached across gap 55. The elastic material 70 biases the two ends of the stabilizing material 50 together, thereby minimizing the width of the gap 55. The elastic material 70 may be sewn or fused to the stabilizing material 50.

Figure 13:
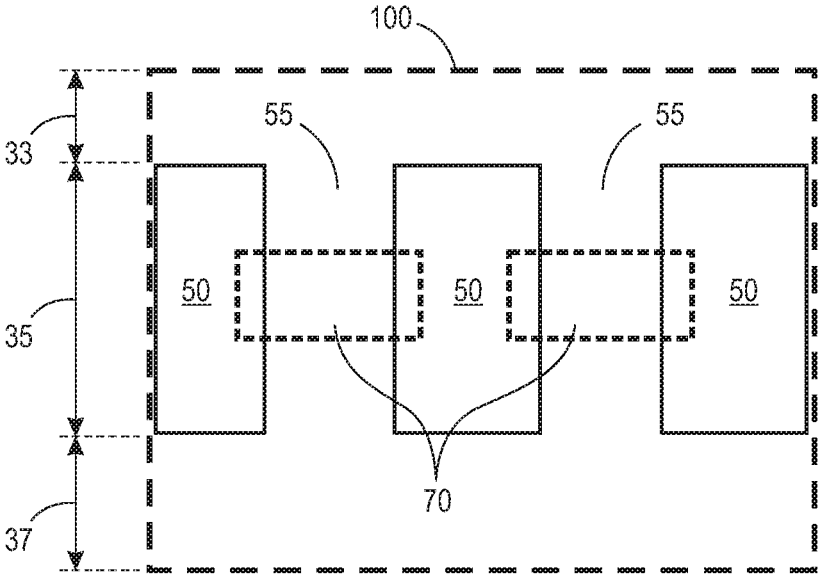
FIG. 13 illustrates a cutaway view of a double layered flexible furniture leg sock with pieces of expandable stabilizing material and elastic members.

FIG. 13 illustrates a furniture leg protective sock 100 that includes an upper portion 33, a middle portion 35, and a bottom portion 37. As illustrated in FIG. 13, in the middle portion 35, pieces of stabilizing material 50 float between an inner layer and an outer layer of the furniture leg protective sock 100.

To prevent the stabilizing material 50 from retaining an expanded state (larger gap), an elastic material 70 is attached across each gap 55. The elastic material 70 biases the two pieces of the stabilizing material 50 together, thereby minimizing the width of each gap 55. The elastic material 70 may be sewn or fused to the pieces of stabilizing material 50.

It is noted that the elastic material 70 may be a single piece of elastic instead of the individual pieces of elastic material 70, as shown in FIG. 13.

Figure 14:
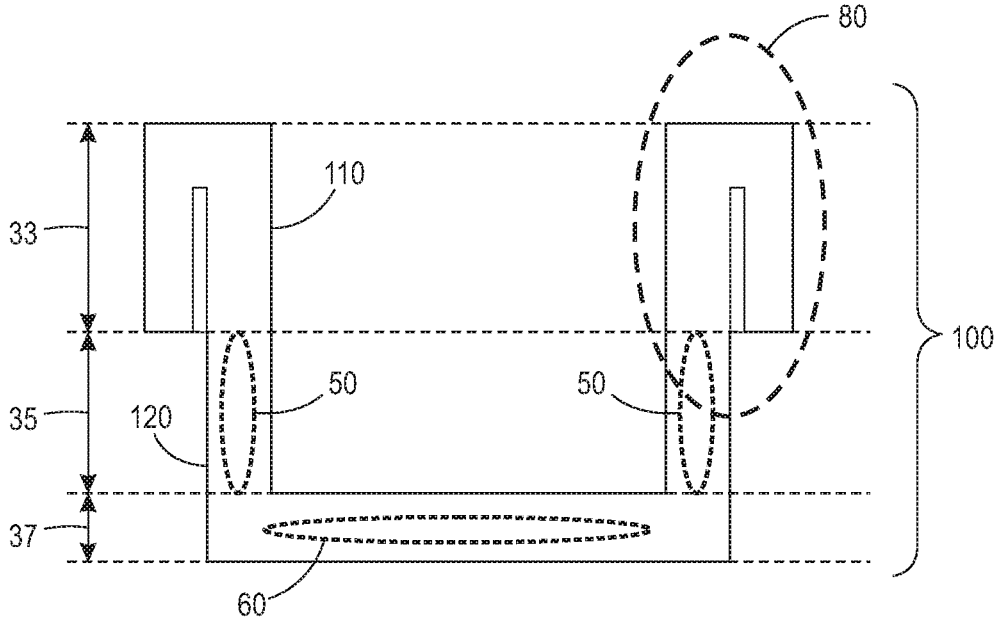
FIG. 14 illustrates a double layered flexible furniture leg sock with a doubled over top portion.

FIG. 14 illustrates a furniture leg protective sock 100 that includes an inner layer 110 and an outer layer 120 forming an upper portion 33, a middle portion 35, and a bottom portion 37. As illustrated in FIG. 14, the upper portion 33 is formed by doubling over (80) the inner layer 110 and an outer layer 120 such that the upper portion 33 composes four layers of material.

The furniture leg protective sock 100 of FIG. 14 may optionally include stabilizing material 50 in the middle portion 35 and non-penetrating material 60 in the bottom portion 33.

In summary, a furniture leg protective sock to prevent a furniture leg from scraping or marring a floor includes a stretchable/expandable double-layered non-friction material to form an outer layer, an inner layer, and a gap therebetween; stabilizing material to provide rigidity and stretchability; and friction material. The stretchable/expandable double-layered non-friction material forms a cupped shape having an inner surface and an outer surface. The friction material is formed on the inner surface, and the stabilizing material is located in the gap between the inner layer and the outer layer.

The stretchable/expandable double-layered non-friction material may include a top portion having an inner surface, an outer surface and an opening to slip the sock onto the furniture leg; a bottom portion having an inner surface and an outer surface, the bottom portion being position between the bottom surface of the furniture leg and the floor when the bottom portion engages the furniture leg; and a middle portion having an inner surface and an outer surface, the middle portion extending between the opening of the top portion and the bottom portion, the middle portion engaging the side surface of the furniture leg.

The middle portion may be substantially orthogonal, when the bottom portion and the middle portion engage the furniture leg, to the bottom portion.

The stabilizing material may be located in the gap between the inner layer and the outer layer located in the middle portion.

The friction material may be applied only to a portion of the inner surface of the bottom portion and to a portion of the inner surface of the middle portion; the friction material applied to the portion of the inner surface of the bottom portion engaging the bottom surface of the furniture leg; the inner surface of the closed bottom portion engaging the bottom surface of the furniture leg; the friction material applied to the portion of the inner surface of the middle bottom portion engaging the side surface of the furniture leg; the inner surface of the middle bottom portion engaging the side surface of the furniture leg; the friction material applied to the portion of the inner surface of the bottom portion minimizing, when the furniture leg is moved across the floor, slippage of the sock parallel to the bottom surface of the furniture leg by providing friction therebetween; the friction material applied to the portion of the inner surface of the middle bottom portion minimizing slippage of the sock parallel to the side surface of the furniture leg by providing friction therebetween.

The friction material may define a geometric pattern on the inner surface, and the friction material may be composed of a rubberized material.

The stabilizing material may float in the gap between the inner layer and the outer layer located in the middle portion.

The stabilizing material may be a plurality of adjacent pieces of stabilizing material that float in the gap between the inner layer and the outer layer located in the middle portion.

The stabilizing material may include a stabilizing material gap.

The furniture leg protective sock may include elastic material, the elastic material being attached, across the stabilizing material gap, to the stabilizing material on either side of the stabilizing material gap.

The adjacent pieces of stabilizing material may include a stabilizing material gap therebetween.

The furniture leg protective sock may include elastic material, the elastic material being attached, across the stabilizing material gap, to adjacent pieces of stabilizing material.

The stabilizing material may be a plurality of adjacent pieces of stabilizing material that are located in the gap between the inner layer and the outer layer located in the middle portion.

A furniture leg protective sock to prevent a furniture leg from scraping or marring a floor includes a stretchable/expandable double-layered non-friction material to form an outer layer, an inner layer, and a gap therebetween; non-penetrating material to prevent a furniture leg from piercing through the stretchable/expandable double-layered non-friction material; and friction material. The stretchable/expandable double-layered non-friction material forms a cupped shape having an inner surface and an outer surface. The friction material is formed on the inner surface. The non-penetrating material is located in the gap between the inner layer and the outer layer.

The stretchable/expandable double-layered non-friction material may include a top portion having an inner surface, an outer surface and an opening to slip the sock onto the furniture leg; a bottom portion having an inner surface and an outer surface, the bottom portion being position between the bottom surface of the furniture leg and the floor when the bottom portion engages the furniture leg; and a middle portion having an inner surface and an outer surface, the middle portion extending between the opening of the top portion and the bottom portion, the middle portion engaging the side surface of the furniture leg.

The middle portion may be substantially orthogonal, when the bottom portion and the middle portion engage the furniture leg, to the bottom portion.

The non-penetrating material may be located in the gap between the inner layer and the outer layer located in the bottom portion.

The friction material may be applied only to a portion of the inner surface of the bottom portion and to a portion of the inner surface of the middle portion; the friction material applied to the portion of the inner surface of the bottom portion engaging the bottom surface of the furniture leg; the inner surface of the closed bottom portion engaging the bottom surface of the furniture leg; the friction material applied to the portion of the inner surface of the middle bottom portion engaging the side surface of the furniture leg; the inner surface of the middle bottom portion engaging the side surface of the furniture leg; the friction material applied to the portion of the inner surface of the bottom portion minimizing, when the furniture leg is moved across the floor, slippage of the sock parallel to the bottom surface of the furniture leg by providing friction therebetween; the friction material applied to the portion of the inner surface of the middle bottom portion minimizing slippage of the sock parallel to the side surface of the furniture leg by providing friction therebetween.

The friction material may define a geometric pattern on the inner surface, and the friction material may be composed of a rubberized material.

A furniture leg protective sock to prevent a furniture leg from scraping or marring a floor includes a stretchable/expandable double-layered non-friction material to form an outer layer, an inner layer, and a gap therebetween; non-penetrating material to prevent a furniture leg from piercing through the stretchable/expandable double-layered non-friction material; stabilizing material to provide rigidity and stretchability; and friction material. The stretchable/expandable double-layered non-friction material forms a cupped shape having an inner surface and an outer surface. The friction material is formed on the inner surface. The non-penetrating material is located in the gap between the inner layer and the outer layer. The stabilizing material is located in the gap between the inner layer and the outer layer.

The stretchable/expandable double-layered non-friction material may include a top portion having an inner surface, an outer surface and an opening to slip the sock onto the furniture leg; a bottom portion having an inner surface and an outer surface, the bottom portion being position between the bottom surface of the furniture leg and the floor when the bottom portion engages the furniture leg; and a middle portion having an inner surface and an outer surface, the middle portion extending between the opening of the top portion and the bottom portion, the middle portion engaging the side surface of the furniture leg.

The middle portion may be substantially orthogonal, when the bottom portion and the middle portion engage the furniture leg, to the bottom portion.

The non-penetrating material may be located in the gap between the inner layer and the outer layer located in the bottom portion.

The stabilizing material may be located in the gap between the inner layer and the outer layer located in the middle portion.

The friction material may be applied only to a portion of the inner surface of the bottom portion and to a portion of the inner surface of the middle portion; the friction material applied to the portion of the inner surface of the bottom portion engaging the bottom surface of the furniture leg; the inner surface of the closed bottom portion engaging the bottom surface of the furniture leg; the friction material applied to the portion of the inner surface of the middle bottom portion engaging the side surface of the furniture leg; the inner surface of the middle bottom portion engaging the side surface of the furniture leg; the friction material applied to the portion of the inner surface of the bottom portion minimizing, when the furniture leg is moved across the floor, slippage of the sock parallel to the bottom surface of the furniture leg by providing friction therebetween; the friction material applied to the portion of the inner surface of the middle bottom portion minimizing slippage of the sock parallel to the side surface of the furniture leg by providing friction therebetween.

The friction material may define a geometric pattern on the inner surface, and the friction material may be composed of a rubberized material.

The non-penetrating material may be located in the gap between the inner layer and the outer layer.

The stabilizing material may be located in the gap between the inner layer and the outer layer.

The stabilizing material may be a plurality of adjacent pieces of stabilizing material located in the gap between the inner layer and the outer layer.

The stabilizing material may include a stabilizing material gap.

The furniture leg protective sock may include elastic material, wherein the elastic material is attached, across the stabilizing material gap, to the stabilizing material on either side of the stabilizing material gap.

The furniture leg protective sock may include elastic material, wherein adjacent pieces of stabilizing material include a stabilizing material gap therebetween, and the elastic material is attached, across the stabilizing material gap, to adjacent pieces of stabilizing material.

A furniture leg protective sock to prevent a furniture leg from scraping or marring a floor includes a stretchable/expandable double-layered non-friction material to form an outer layer, an inner layer, and a gap therebetween; non-penetrating material to prevent a furniture leg from piercing through the stretchable/expandable double-layered non-friction material; and friction material. The stretchable/expandable double-layered non-friction material forms a cupped shape having an inner surface and an outer surface. The stretchable/expandable double-layered non-friction material includes a top portion; a bottom portion having an inner surface and an outer surface; and a middle portion having an inner surface and an outer surface. The friction material is formed on the inner surface of the middle portion. The non-penetrating material is located in the bottom portion.

The non-penetrating material may be located on the inner surface of the bottom portion.

The non-penetrating material may be located in the gap between the inner layer and the outer layer located in the bottom portion.

A furniture leg protective sock to prevent a furniture leg from scraping or marring a floor includes a stretchable/expandable double-layered non-friction material to form an outer layer, an inner layer, and a gap therebetween; non-penetrating material to prevent a furniture leg from piercing through the stretchable/expandable double-layered non-friction material; stabilizing material to provide rigidity and stretchability; and friction material. The stretchable/expandable double-layered non-friction material forms a cupped shape having an inner surface and an outer surface. The stretchable/expandable double-layered non-friction material includes a top portion; a bottom portion having an inner surface and an outer surface; and a middle portion having an inner surface and an outer surface. The friction material is formed on the inner surface of the middle portion. The non-penetrating material is located in the bottom portion. The stabilizing material is located in the gap between the inner layer and the outer layer.

The non-penetrating material may be located in the gap between the inner layer and the outer layer.

The non-penetrating material may be located on the inner surface of the bottom portion.

The stabilizing material may be located in the gap between the inner layer and the outer layer.

The stabilizing material may be a plurality of adjacent pieces of stabilizing material located in the gap between the inner layer and the outer layer.

The furniture leg protective sock further includes elastic material; the stabilizing material including a stabilizing material gap; the elastic material being attached, across the stabilizing material gap, to the stabilizing material on either side of the stabilizing material gap.

The furniture leg protective sock further includes elastic material; the adjacent pieces of stabilizing material including a stabilizing material gap therebetween; the elastic material being attached, across the stabilizing material gap, to adjacent pieces of stabilizing material.

A furniture leg protective sock includes a non-friction material. The non-friction material includes a top portion having an interior surface, an exterior surface and an opening to slip the sock onto the furniture leg, a closed bottom portion having an interior surface and an exterior surface, the closed bottom portion being position between the bottom surface of the furniture leg and the floor when the closed bottom portion engages the furniture leg, and a middle portion having an interior surface and an exterior surface, the middle portion extending between the opening of the top portion and the closed bottom portion, the middle portion engaging the side surface of the furniture leg The middle portion is substantially orthogonal, when the closed bottom portion and the middle portion engage the furniture leg, to the closed bottom portion.

The furniture leg protective sock also includes friction material being applied only to a portion of the interior surface of the closed bottom portion and to a portion of the interior surface of the middle portion.

The friction material applied to the portion of the interior surface of the closed bottom portion engages the bottom surface of the furniture leg. The interior surface of the closed bottom portion engages the bottom surface of the furniture leg.

The friction material applied to the portion of the interior surface of the middle bottom portion engages the side surface of the furniture leg. The interior surface of the middle bottom portion engages the side surface of the furniture leg.

The friction material applied to the portion of the interior surface of the closed bottom portion minimizes, when the furniture leg is moved across the floor, slippage of the sock parallel to the bottom surface of the furniture leg by providing friction therebetween.

The friction material applied to the portion of the interior surface of the middle bottom portion minimizes slippage of the sock parallel to the side surface of the furniture leg by providing friction therebetween.

The friction material enhances the friction between the sock and the furniture leg.

The exterior surface of the top portion, closed bottom portion, and the middle portion is without any of the friction material.

The closed bottom portion includes an overcast seam to provide a cushion between the furniture leg and the floor.

The top portion may include a finished top edge.

The finished top edge may be a double backed section of the sock.

The sock may be capable of being stretched to different widths.

The friction material may define a geometric pattern on the interior surface.

The friction material may provide an additional layer of insulation to the closed bottom portion of the sock.

The friction material may include a form of rubberized material.

A furniture leg protective sock consists essentially of a non-friction material and friction material. The non-friction material includes a top portion having an interior surface, an exterior surface and an opening to slip the sock onto the furniture leg, a closed bottom portion having an interior surface and an exterior surface, the closed bottom portion being position between the bottom surface of the furniture leg and the floor when the closed bottom portion engages the furniture leg, and a middle portion having an interior surface and an exterior surface, the middle portion extending between the opening of the top portion and the closed bottom portion, the middle portion engaging the side surface of the furniture leg.

The middle portion is substantially orthogonal, when the closed bottom portion and the middle portion engage the furniture leg, to the closed bottom portion.

The friction material is applied only to a portion of the interior surface of the closed bottom portion and to a portion of the interior surface of the middle portion.

The friction material applied to the portion of the interior surface of the closed bottom portion engages the bottom surface of the furniture leg. The interior surface of the closed bottom portion engages the bottom surface of the furniture leg.

The friction material applied to the portion of the interior surface of the middle bottom portion engages the side surface of the furniture leg. The interior surface of the middle bottom portion engaging the side surface of the furniture leg.

The friction material applied to the portion of the interior surface of the closed bottom portion minimizes, when the furniture leg is moved across the floor, slippage of the sock parallel to the bottom surface of the furniture leg by providing friction therebetween.

The friction material applied to the portion of the interior surface of the middle bottom portion minimizes slippage of the sock parallel to the side surface of the furniture leg by providing friction therebetween.

The friction material enhances the friction between the sock and the furniture leg.

The exterior surface of the top portion, closed bottom portion, and the middle portion is without any of the friction material. The closed bottom portion includes an overcast seam to provide a cushion between the furniture leg and the floor.

The top portion may include a finished top edge.

The finished top edge may be a double backed section of the sock.

The sock may be capable of being stretched to different widths.

A furniture leg protective sock to prevent a furniture leg from scraping or marring a floor comprises a stretchable/expandable double-layered non-friction material to form an outer layer, an inner layer, and a gap therebetween, the outer layer having a first outer layer surface and a second outer layer surface, the inner layer having a first inner layer surface and a second inner layer surface, the first outer layer surface and the first inner layer surface being continuous, the second outer layer surface and the second inner layer surface being continuous; and friction material; the friction material being formed on the inner layer.

A furniture leg protective sock to prevent a furniture leg from scraping or marring a floor comprises a stretchable/ expandable double-layered non-friction material to form an outer layer, an inner layer, and a gap therebetween; and friction material; the stretchable/expandable double-layered non-friction material forming a cupped shape having an inner surface and an outer surface; the stretchable/expandable double-layered non-friction material including a top portion; a bottom portion having an inner surface and an outer surface; and a middle portion having an inner surface and an outer surface; the friction material being formed on the inner surface of the middle portion.

A furniture leg protective sock to prevent a furniture leg from scraping or marring a floor, comprises a stretchable/expandable double-layered non-friction material to form an outer layer, an inner layer, and a gap therebetween; and friction material; the stretchable/expandable double-layered non-friction material forming a cupped shape; the stretchable/expandable double-layered non-friction material including a top portion; a bottom portion having an inner surface and an outer surface; and a middle portion having an inner surface and an outer surface; the friction material being formed on the inner surface of the middle portion.

A furniture leg protective sock to prevent scraping of a floor by furniture having a furniture leg, the furniture leg having a bottom surface for engaging the floor and a side surface substantially orthogonal to the bottom surface, the sock comprising expandable non-friction material; and friction material; the expandable non-friction material allowing the bottom surface of the furniture leg to slide across the floor; the expandable non-friction material including, a top portion having an interior surface, an exterior surface and an opening to slip the sock onto the furniture leg, a closed bottom portion having an interior surface and an exterior surface, the closed bottom portion covering the bottom surface of the furniture leg and the floor when the closed bottom portion engages the bottom surface of the furniture leg, and a middle portion having an interior surface and an exterior surface, the middle portion extending between the opening of the top portion and the closed bottom portion, the middle portion engaging the side surface of the furniture leg; the middle portion being substantially orthogonal, when the closed bottom portion and the middle portion engage the furniture leg, to the closed bottom portion; the friction material being formed on a first portion of the interior surface of the middle portion of the expandable non-friction material; the interior surface of the closed bottom portion of the expandable non-friction material engaging the bottom surface of the furniture leg; a second portion of the interior surface of the middle bottom portion of the expandable non-friction material and the friction material formed on the first portion of the interior surface of the middle portion engaging the side surface of the furniture leg; the friction material formed on the first portion of the interior surface of the middle portion of the expandable non-friction material minimizing, when the furniture leg is moved across the floor, slippage of the sock parallel to the side surface of the furniture leg by providing friction therebetween; the second portion of the interior surface of the middle portion of the expandable non-friction material being without any of the friction material thereon.

The expandable non-friction material may be capable of being stretched to different widths.

The friction material may define a geometric pattern on the interior surface.

The friction material may include rubberized material.

A furniture leg protective sock to prevent scraping of a floor by furniture having a furniture leg, the furniture leg having a bottom surface for engaging the floor and a side surface substantially orthogonal to the bottom surface, the sock comprising expandable non-friction material; and friction material; the expandable non-friction material allowing the bottom surface of the furniture leg to slide across the floor; the expandable non-friction material including, a top portion having an interior surface, an exterior surface and an opening to slip the sock onto the furniture leg, a closed bottom portion having an interior surface and an exterior surface, the closed bottom portion covering the bottom surface of the furniture leg and the floor when the closed bottom portion engages the bottom surface of the furniture leg, and a middle portion having an interior surface and an exterior surface, the middle portion extending between the opening of the top portion and the closed bottom portion, the middle portion engaging the side surface of the furniture leg; the middle portion being substantially orthogonal, when the closed bottom portion and the middle portion engage the furniture leg, to the closed bottom portion; the friction material being formed on a first portion of the interior surface of the closed bottom portion of the expandable non-friction material; the interior surface of the middle portion of the expandable non-friction material engaging the bottom surface of the furniture leg; a second portion of the interior surface of the closed bottom portion of the expandable non-friction material and the friction material formed on the first portion of the interior surface of the closed bottom portion engaging the side surface of the furniture leg; the friction material formed on the first portion of the interior surface of the closed bottom portion minimizing, when the furniture leg is moved across the floor, slippage of the sock parallel to the side surface of the furniture leg by providing friction therebetween; the second portion of the interior surface of the closed bottom portion of the expandable non-friction material being without any of the friction material thereon.

The expandable non-friction material may be capable of being stretched to different widths.

The friction material may define a geometric pattern on the interior surface.

The friction material may include rubberized material.

A furniture leg protective sock to prevent a furniture leg from scraping or marring a floor, comprising a stretchable/expandable double-layered non-friction material to form an outer layer, an inner layer, and a gap therebetween; and friction material; the stretchable/expandable double-layered non-friction material forming a cupped shape having an inner surface, being part of the inner layer, and an outer surface, being part of the outer layer; the stretchable/expandable double-layered non-friction material including a top portion; a bottom portion having a first bottom portion surface, being part of the inner layer, and a second bottom portion surface, being part of the outer layer; and a middle portion having a first middle portion surface, being part of the inner layer, and a second middle portion surface, being part of the outer layer; the friction material being formed on the first bottom portion surface of the bottom portion for engaging the furniture leg.

It will be appreciated that variations of the above-disclosed embodiments and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the description above and the following claims.

What is claimed is:

1. A furniture leg protective sock having a top portion, a middle portion, and a bottom portion, to prevent a furniture leg from scraping or marring a floor, the bottom portion of the furniture leg protective sock engaging the floor, comprising:

a non-friction material; and non-penetrating material to prevent the furniture leg from piercing through said non-friction material; and said non-friction material forming a tube shape having an inner surface for engaging the furniture leg;

said non-friction material forming the top portion of the furniture leg protective sock and the middle portion of the furniture leg protective sock;

said non-penetrating material being located in the bottom portion of the furniture leg protective sock;

said non-penetrating material consisting of a rubber material.

2. The furniture leg protective sock of claim 1, wherein said non-friction material is capable of being stretched to different widths.

3. The furniture leg protective sock of claim 1, further comprising friction material located on said inner surface of said non-friction material.

4. The furniture leg protective sock of claim 1, wherein said non-friction material consists of a fabric material.

5. A furniture leg protective sock to prevent a furniture leg from scraping or marring a floor, comprising:

a stretchable/expandable double-layered non-friction material to form an outer layer of stretchable/expandable non-friction material, an inner layer of stretchable/expandable non-friction material, and a gap therebetween; and non-penetrating material to prevent the furniture leg from piercing through said stretchable/expandable double-layered non-friction material;

said stretchable/expandable double-layered non-friction material forming a cupped shape having an inner surface, associated with said inner layer, for engaging the furniture leg and an outer surface associated with said outer layer;

said stretchable/expandable double-layered non-friction material including a top portion, a bottom portion having an inner surface associated with said inner layer and an outer surface associated with said outer layer, and a middle portion having an inner surface associated with said inner layer and an outer surface associated with said outer layer;

said non-penetrating material being located in said bottom portion.

6. The furniture leg protective sock as claimed in claim 5, wherein said non-penetrating material is located on said inner surface of said bottom portion.

7. The furniture leg protective sock as claimed in claim 5, wherein said non-penetrating material is located in said gap between said inner layer and said outer layer located in said bottom portion.

8. The furniture leg protective sock of claim 5, wherein said non-penetrating material is a felt pad.

9. The furniture leg protective sock of claim 5, wherein said non-penetrating material consists of a rubber material.

10. A furniture leg protective sock having a top portion, a middle portion, and a bottom portion, to prevent a furniture leg from scraping or marring a floor, the bottom portion of the furniture leg protective sock engaging the floor, comprising:

a first non-friction fabric material;

a second non-friction fabric material; and non-penetrating material to prevent the furniture leg from piercing through said second non-friction fabric material; and said first non-friction fabric material forming a tube shape having an inner surface for engaging the furniture leg;

said first non-friction fabric material forming the top portion of the furniture leg protective sock and the middle portion of the furniture leg protective sock;

said non-penetrating material being located in the bottom portion of the furniture leg protective sock;

said second non-friction fabric material being located in the bottom portion of the furniture leg protective sock such that said second non-friction fabric material engages the floor.

11. The furniture leg protective sock of claim 10, wherein said first non-friction fabric material is capable of being stretched to different widths.

12. The furniture leg protective sock of claim 10, wherein said non-penetrating material is a felt pad.

13. The furniture leg protective sock of claim 10, wherein said non-penetrating material consists of a rubber material.

14. The furniture leg protective sock of claim 10, further comprising friction material located on said inner surface of said first non-friction fabric material.

15. The furniture leg protective sock of claim 10, wherein said first non-friction fabric material and said second non-friction fabric material are a single continuous fabric material.

* * * * *